US007264479B1

(12) United States Patent
Lee

(10) Patent No.: US 7,264,479 B1
(45) Date of Patent: Sep. 4, 2007

(54) COAXIAL CABLE MAGNETIC CONNECTOR

(76) Inventor: Vincent J. Lee, 17316 Edwards Rd., #105, Cerritos, CA (US) 90703

( * ) Notice: Subject to any disclaimer, the term of this patent is extended or adjusted under 35 U.S.C. 154(b) by 0 days.

(21) Appl. No.: 11/445,271

(22) Filed: Jun. 2, 2006

(51) Int. Cl.
*H01R 11/30* (2006.01)

(52) U.S. Cl. ..... 439/39; 439/578

(58) Field of Classification Search ..... 439/578, 439/39

See application file for complete search history.

(56) References Cited

U.S. PATENT DOCUMENTS 3,521,216 A * 7/1970 Tolegian ..... 439/39
3,808,577 A * 4/1974 Mathauser ..... 439/39
5,401,175 A * 3/1995 Guimond et al. ..... 439/38
5,921,783 A * 7/1999 Fritsch et al. ..... 439/38
6,565,363 B2 * 5/2003 Downing ..... 439/39

* cited by examiner

*Primary Examiner*—Truc Nguyen
(74) *Attorney, Agent, or Firm*—Edward E. Roberts

(57) ABSTRACT

Male and female elements of a co-axial cable connector include permanent magnets for the connective force between the male and female elements, a magnet of one polarity in the male element and one of opposite polarity in the female element. The male and female elements are designed and configured to provide a reliable electrical connection while at the same time allowing for quick and easy disconnect of the elements without damage to the connector when it is subjected to inadvertent break away forces. When connecting a musical instrument to a speaker and subjecting the connector to quick inadvertent disconnect there is no resultant disruptive noise or damage to the electrical system.

18 Claims, 3 Drawing Sheets

Fig. 8
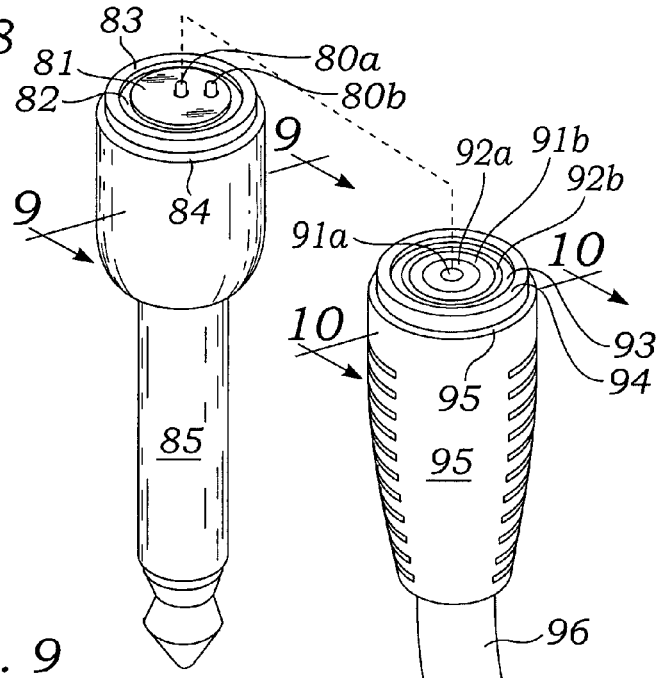
Fig. 9
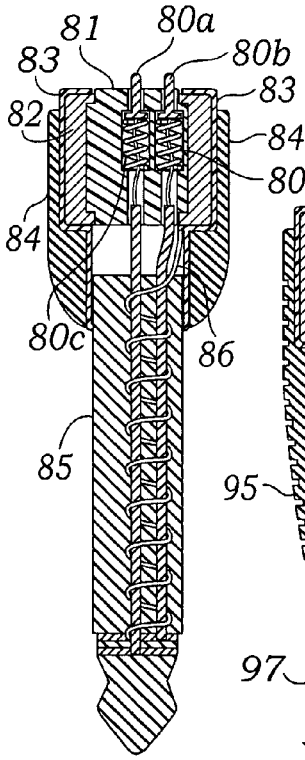
Fig. 10
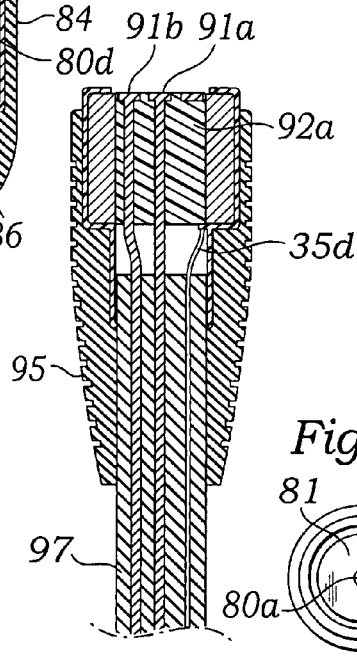
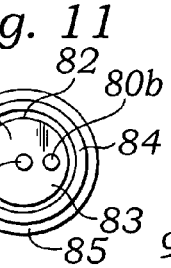
Fig. 11
Fig. 12
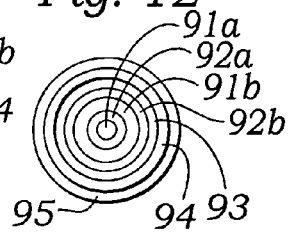

COAXIAL CABLE MAGNETIC CONNECTOR

BACKGROUND

The background of the invention will be discussed in two parts.

1. Field of the Invention

The invention relates to electrical coaxial cables, and more particularly, to magnetic hold and release connector apparatus for a coaxial cable.

2. Description of the Prior Art

A great variation of electrical connectors is to be found in the marketplace, each generally optimized for a particular usage with a particular set of electrical characteristics. Design of an electrical connector for a particular usage will include the electrical parameters for the circuit in which the connector will be used, the sensitivity of the connector to the environment in which it will be used, the ease in which the connection/disconnection can be made, the desired reliability of the connection, and the expected cost of the connector,.

In considering the ease in which the connection/disconnection can be made, connectors having magnetic hold and release capabilities have been developed. One cable connector arrangement exemplary of the prior art is shown and described in U.S. Pat. No. 4,025,964, issued to Owens on 31 May 1977 wherein the plug is held in the socket by a magnet in the socket and magnetic material in the plug. Another such arrangement is shown and described in U.S. Pat. No. 4,211,456, issued to Sears on 08 Jul. 1980 wherein a male and female electrical connector are held together via a permanent magnet inside the female connector.

Such devices are illustrative of arrangements whereby attempts have been made to provide magnetic disconnects for electrical connectors. However, there is a need for a magnetic disconnect for coaxial connectors providing ease of connection/disconnection combined with desired reliability of the connection. For a coaxial cable system, the objective of the connector is to provide a coacting male and female arrangement with magnetic connective capability wherein the impedance of the system in use is not materially affected. Coaxial cables generally include a center conductor surrounded by an insulation layer which in turn is surrounded by a flexible braid tube or sleeve. In the connector both male and female portions include a central contact electrically connected to the center conductor and some form of sleeve construction connected to the braid and surrounding the interconnected male and female central contacts. An embodiment is included for a dual feed as may be used in a stereophonic system.

It is thus an aspect of the present invention to provide a new and improved configuration for a coaxial cable that is easily attached and detached whereby the force holding the male and female connector elements together is by a permanent magnet. It is a further objective of the invention to provide a coaxial cable that is suitable for use in an environment in which it is subject to frequent inadvertent disconnection during its useful life. It is another aspect of the invention to provide magnetic connector means for a coaxial cable that easily and reliably releases when subjected to pull away forces with the result that the cable is not thereby damaged.

SUMMARY

In accordance with the present invention, there is disclosed a co-axial cable connector wherein the connective means between the male and female elements includes permanent magnets, a magnet element of one polarity in the male element and one of opposite polarity in the female element. The male and female elements are configured to allow a reliable electrical connection to be created via the magnetic attraction of the two elements while at the same time allowing for quick and easy disconnect without damage when the connector is subjected to inadvertent pull away forces. With mating of the male and female elements a continuous electrical shield is provided protecting the signal on the center conductor of the coaxial cable by minimizing stray interference. Insulators and other connector components, have proper spacing and dielectric constants to ensure that electrical impedance is sufficiently matched, thereby minimizing electrical losses due to reflections or leakage. When connecting a musical instrument to a speaker and subjecting the connector to quick inadvertent disconnect there is no resultant disruptive noise nor is there damage to the electrical system.

DRAWINGS

FIG. 8 is a perspective view of the magnetic connector of the invention illustrating the male and female mating faces for an embodiment providing stereophonic signal capability;

FIG. 9 is a cross-sectional view of the male mating element of the magnetic connector of FIG. 8 taken along lines 9-9 of FIG. 8;

FIG. 10 is a is a cross-sectional view of the female mating element of the connector of FIG. 8 taken along lines 10-10 of FIG. 8;

FIG. 11 is a top view indicative of the male mating surface of FIG. 9; and FIG. 12 is a top view indicative of the female mating surface of FIG. 10.

DESCRIPTION

Figure 1:
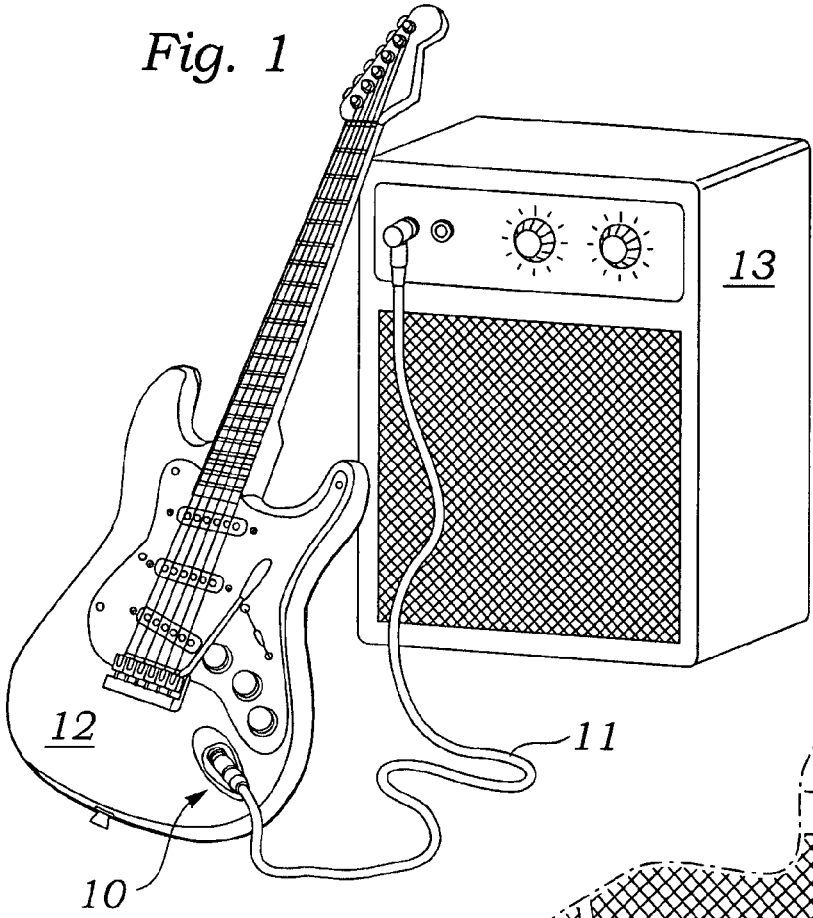
FIG. 1 is a perspective view illustrating the coaxial cable and magnetic connector of the invention as used in connecting a musical instrument to a loud speaker.

Referring now to the drawings, in which like reference numerals refer to like elements in the several views, there is illustrated a first embodiment of the magnetic connector of the invention wherein mated male and female elements of a co-axial contact system include a permanent magnet for the connective force between the male and female elements. The male and female elements are designed and configured to provide a reliable electrical connection via the magnetic attraction of the two elements while at the same time allowing for quick and easy disconnect of the elements without damage to the connector when subjected to inadvertent pull away forces. As is conventional, the basic coaxial cable includes a central signal conductor surrounded by an inner insulation layer, which is encased in a flexible conductive braid tube or sleeve, the assembly then being enclosed in an outer insulating layer. The central conductor is ordinarily a multi-stranded or solid conductor. When connecting a musical instrument to a speaker and subjecting the connector to abrupt disconnect there is no resultant disruptive noise nor is there damage to the electrical system.

FIG. 1 is a perspective view illustrating the magnetic connector of the invention, generally designated 10, as used in connecting, by means of coaxial cable 11, a musical instrument such as a guitar 12 to a loud speaker 13. Cable 11 is connected to speaker 13 in any manner as is conventional with co-axial cables.

Figure 2:
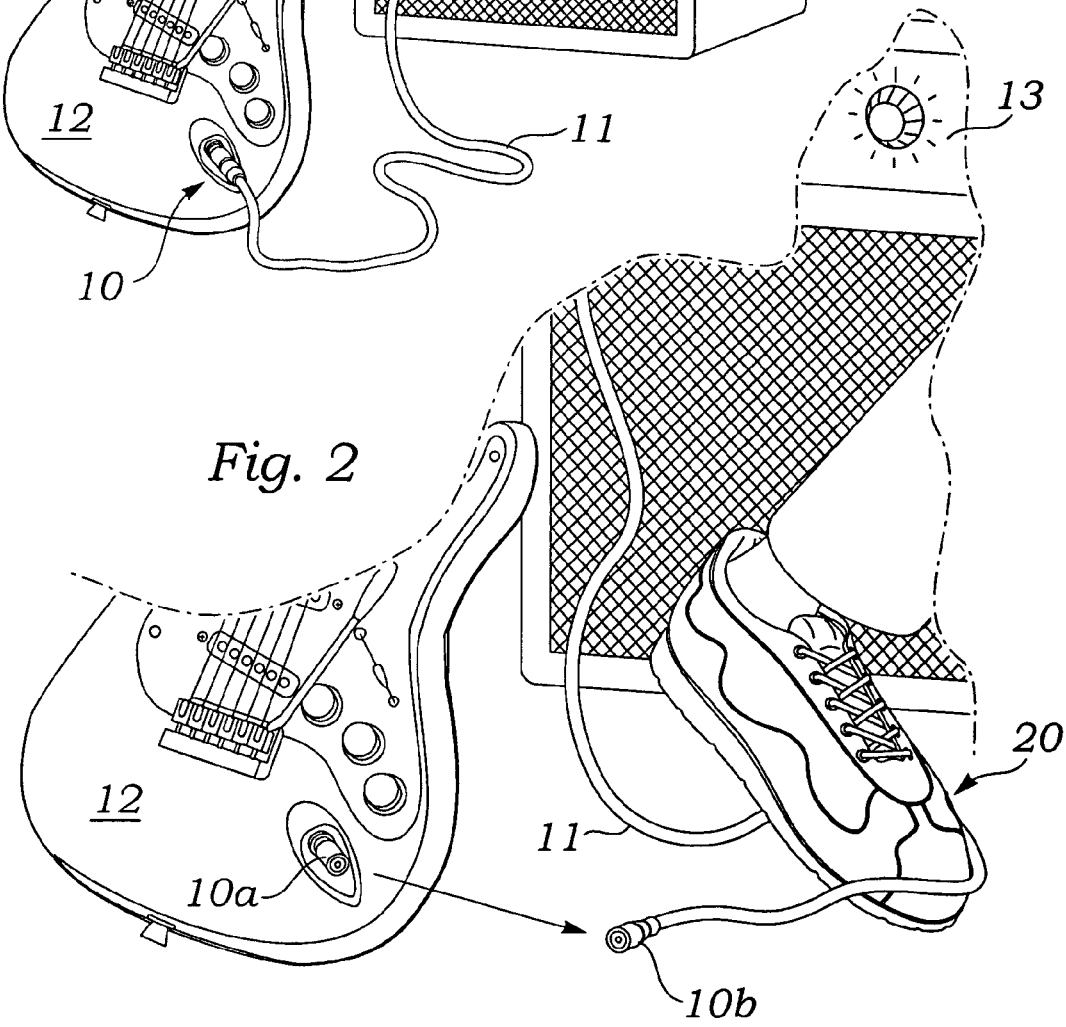
FIG. 2 is a perspective view of the coaxial cable and magnetic connector as shown in FIG. 1 having been inadvertently disconnected from the connected condition as a result of force applied by an entangled foot.

FIG. 2 illustrates the break-away characteristic of the invention, connector 10 being inadvertently disconnected by an entangled foot, generally designated 20. Shown is male connector element 10*a* connected to guitar 12 by means of a conventional coaxial jack or plug, as will be discussed, and cable 11 having female connector element 10*b* at one end for mating with connector element 10*a* and at the other end connected to speaker 13. However, the location of the male element 10*a* and female element 10*b* could be reversed such that the female element 10*b* is connected to the guitar 12 with he male element 10*a* connected to the cable 11.

Figure 3:
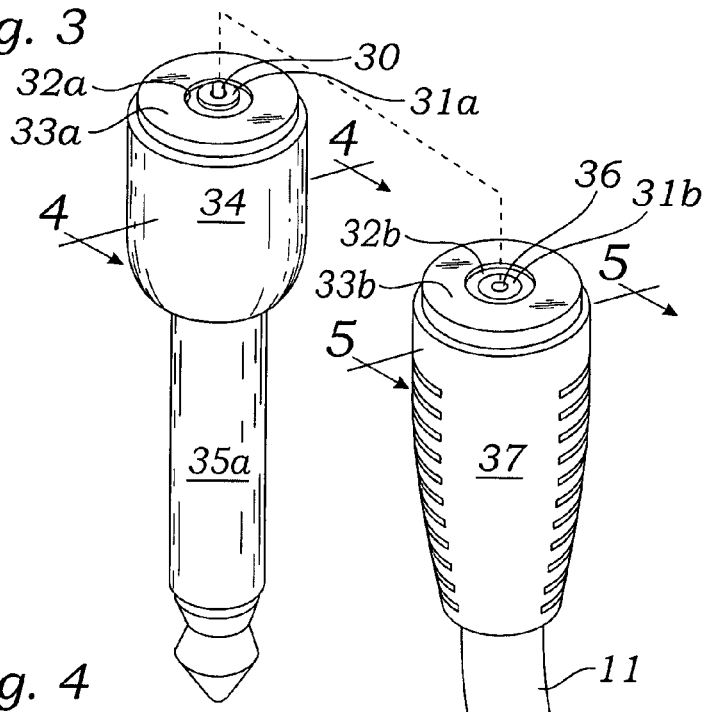
FIG. 3 is a perspective view of the coaxial cable and magnetic connector as shown in FIG. 1 illustrating the male and female mating faces in accordance with the invention.

FIG. 3 illustrates the male 10*a* and female 10*b* mating faces of connector 10. Male element 10*a* includes the metallic, signal conductive pin contact 30, cylindrical insulator member 31*a*, permanent magnet 32*a*, and tubular conductive metallic shielding/ground sleeve 33*a*. Also included is rubber housing 34 for male element 10*a* and conventional jack or plug 35*a*. Female element 12*b* includes the metallic, signal conductive socket 36 for receiving pin contact 30, cylindrical dielectric insulator member 31*b*, permanent magnet 32*b* of opposite polarity to permanent magnet 32*a*, and conductive shielding/ground sleeve 33*b* for abutting connective relationship with shielding/ground 33*a* of male element 10*a*. Also included is rubber housing 37 for female element 12*b*, cable 11 and conventional jack or plug 35*b*.

Figure 4:
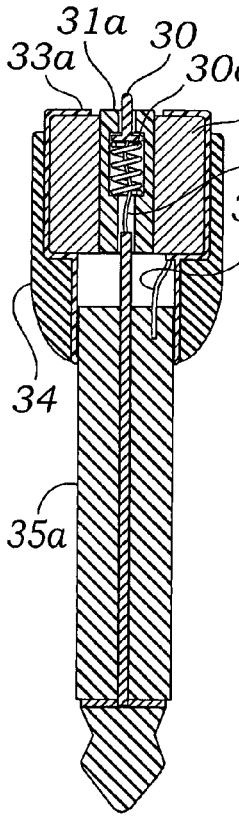
FIG. 4 is a cross-sectional view of the male mating element of the connector taken along lines 4-4 of FIG. 3.

FIG. 4 illustrates male mating element 10*a* taken along lines 4-4 of FIG. 3. The signal pin 30 is responsive to spring means 30*a* providing that pin 30 protrudes sufficiently to mate with signal socket 36 thereby to establish and maintain signal integrity through connector 10. Pin contact 30 is connected to flexible signal strip 30*b* that extends through spring means 30*a* and connects to the signal conductor of cable 11 to maintain signal contact with the signal conductor of plug 35*a*. Pin 30 is generally T-shaped having a generally circular base for abutment with the top of spring means 30*a*. Spring means 30*a* rests on shoulders provided by cylindrical dielectric member 31*a*. Thus, in the unmated position spring means 30a urges pin 30 to protrude from the mating surface of male element 10*a*. Pin 30, spring means 30*a* and signal strip 30*b* are enclosed by elongated cylindrical dielectric member 31*a* and in turn surrounded by elongated cylindrical magnet 32*a*, which in turn is surrounded by shielding/ground 33*a*. Shielding/ground 33*a* is configured in a circular manner to sufficiently cover the mating surface of male element 10*a* such that when abuttingly mated with the corresponding shielding/ground 33*b* (FIG. 5) of female element 10*b* appropriate signal shielding is achieved. The dielectric member 31*a* and housing/ground 33*a* have openings configured with inner diameters permitting protrusion of pin contact 30 therethrough. Shielding/ground 33*a* is shown connected by ground strip 33*c* to the ground of coaxial plug 35*a*. Although shown in a conventional manner, spring means 30*a* may take any configuration as appropriate.

Figure 5:
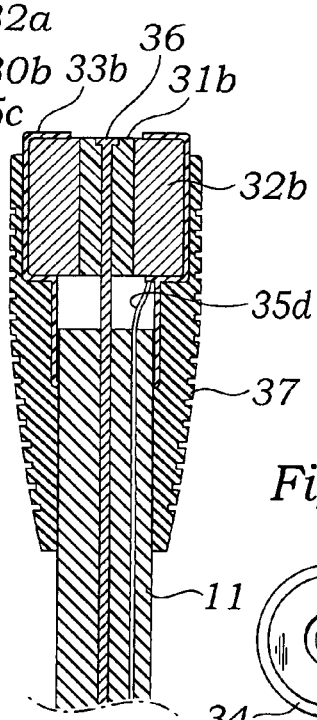
FIG. 5 is a is a cross-sectional view of the female mating element of the connector taken along lines 5-5 of FIG. 3.
Figure 5:
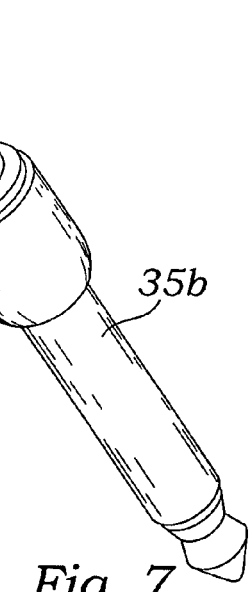

FIG. 5 illustrates female mating element 10*b* of connector 10 taken along lines 5-5 of FIG. 3. Signal socket 36 is recessed for receiving pin contact 30 for mating of elements 10*a* and 10*b*. Socket 36 is surrounded by dielectric insulator 31*b*, and in turn by cylindrical permanent magnet 32*b* which is of opposite polarity to magnet 32*a*, and in turn surrounded by shielding/ground sleeve 33*b* which is configured for mating with shielding/ground 33*a* of male element 10*a*. The open end of receiving socket 36 is generally coplanar with adjacent insulation 31*b* and magnet 32*b*. Shielding/ground 33*b* is shown connected by ground strip 33*d* to the ground of cable 11. Also shown is rubber housing 37.

In connection of male element 10*a* and female element 10*b* the force of spring means 30*a* initially has pin 30 protruding from the shielding/ground 33*a* mating surface. When bringing the mating elements 10*a*, 10*b* in close proximity the force of the magnets 32*a* and 32*b* will "grab" the elements and pull them together with any mismatch of pin 30 and socket 36 depressing pin 30 to compress spring means 30*a* whereby pin 30 no longer protrudes from shielding/ground 33*a*. Once the mismatch is corrected pin 30 will be forced into socket 36 by spring means 30*a*. The attraction force of magnets 32*a*, 32*b* is such as to maintain connection of the mating elements 10*a*, 10*b* under normal conditions while disconnecting when subjected to inadvertent disconnect forces.

Shielding/grounds 33*a* and 33*b* are configured in a circular manner to sufficiently cover the mating surfaces of elements 10*a* and 10*b* respectively and are in full abutment when pin 30 is connected to receiving socket 36 by means of magnets 32*a* and 32*b*, thus providing a continuous electrical shield protecting the signal on the center conductor of cable 11 by minimizing stray interference. Insulators 31*a* and 31*b*, and other connector components, have proper spacing and dielectric constants to ensure that electrical impedance is sufficiently matched, thereby minimizing electrical losses due to reflections or leakage.

Figure 6:
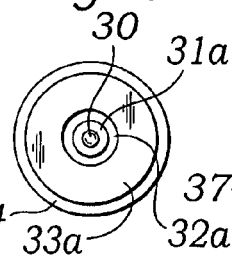
FIG. 6 is a top view indicative of the male mating surface of FIG. 4.

FIG. 6 is a top view further indicating the configuration of the male connector element 10*a*. Shown as previously described is pin 30, insulator 3l*a*, magnet 32*a*, shield/ground 33*a* and housing 34.

Figure 7:
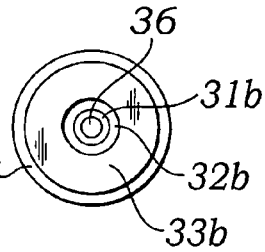
FIG. 7 is a top view indicative of the female mating surface of FIG. 5.

FIG. 7 is a top plan view further indicating the configuration of the mating surface of female connector element 10*b*. Shown as previously described is socket 36, insulator 31*a*, magnet 32*b*, shield/ground 33*b* and housing 37.

FIG. 8 illustrates another embodiment of the magnetic connector of the invention for providing stereophonic signal capability. As shown, the male element includes first and second signal conductive pins 80*a* and 80*b* respectively, dielectric insulator member 81 encompassing both signal pins 80*a* and 80*b* and insulating one from the other, permanent magnet 82, tubular conductive metallic shielding/ground sleeve 83, rubber housing 84, and jack 85. The female element includes first signal socket 91*a* for receiving pin 80*a* insulated by first dielectric member 92*a*, second signal socket 91*b* for receiving pin 80*b* insulated by dielectric member 92*b*, magnet 93 of opposite polarity to magnet 82 surrounded by shielding/ground 94 which is configured for mating with shielding/ground 83 of the male element, and housing 95. Also shown is cable 96 and plug 97.

FIG. 9 illustrates in cross-section the male mating surface of the connector of FIG. 8 taken along lines 9-9 thereof. Shown are first and second signal pins 80*a* and 80*b*, insulator member 81, permanent magnet 82, conductive shielding/ground sleeve 83, housing 84, and jack 85. Signal pins

80*a* and 80*b* include spring means 80*c* and 80*d*, respectively, and flexible signal strips as previously described. Shielding/ground 83 is connected to ground strip 86 which is wound around the signal leads and connected to the ground of jack 85. It is thus seen that this stereophonic signal embodiment includes addition of a second signal configuration having pin 80*b* that is substantially identical to, but insulated from, the first signal configuration having pin 80*a*, the configurations having a common ground. Spring means 80*c*, 80*d* and associated signal strips may be of any suitable configuration in accordance with the invention.

FIG. 10 illustrates in cross-section the female mating surface of the connector of FIG. 8 taken along lines 10-10 thereof. Signal conductive sockets 91*a* and 91*b* are recessed for receiving pin contacts 80*a* and 80*b* respectively upon connection of the male and female elements. Socket 91*a* is centrally placed surrounded by dielectric insulator 92*a*, and in turn by circular formed socket 91*b* which is then insulated by dielectric 92*b*, which is then surrounded by cylindrical magnet 93 of opposite polarity to magnet 82, and in turn by surrounded by shielding/ground sleeve 94 for mating with shielding/ground 83 of the male element. Shielding/ground 94 is shown connected by ground lead 98 to the ground of cable 97. Also shown is rubber housing 95.

FIG. 11 is a top view further indicating the configuration of the male mating surface of FIG. 9. Shown as previously described is first and second signal pins 80*a* and 80*b*, insulator member 81, permanent magnet 82, conductive shielding/ground sleeve 83, and rubber housing 84.

FIG. 12 is a top view further indicating the configuration of the female mating surface of FIG. 10. Shown as previously described is signal conductive sockets 91*a* and 91*b*, dielectric insulators 92*a* and 92*b*, magnet 93, shielding/ground sleeve 94, and rubber housing 95.

In connection of male and female elements of the stereophonic embodiment the procedure is similar to that of the single signal configuration as previously explained. That is, the force of the spring means in each case initially has the contact pins protruding from the shielding/ground mating surface but when bringing the mating elements close proximity the magnets pull the mating elements together with mismatch depressing the pins against the spring means whereby the pins no longer protrude. Once the mismatch is corrected the pins will be forced into the sockets by expansion of the compressed spring means.

The invention has been shown and described with reference to specific illustrated embodiments. It is realized that those skilled in the art may make changes or modifications in the invention without departing from the true scope and spirit of it. Therefore, the scope and spirit of the invention should not be limited to the embodiments discussed, but only by the invention as claimed.

What is claimed is:

1. A connector assembly for a coaxial cable comprising:

a first element having a conductive signal member and a second element having a complementary member for contacting said signal member;

said first element and said second element having mating faces for electrically mating said signal member and said complementary member;

magnetic means in said first and second elements for maintaining connection of said elements while disconnecting said elements upon subjection of disconnect forces to said cable; and said mating faces are electrically connected to respective cable braids and extend beyond respective magnetic means of said first and second elements.

2. The connector assembly of claim 1 wherein said connector further includes spring means for urging contact of said signal member and said complementary member.

3. The connector assembly of claim 1 wherein mating of said mating faces provides a continuous electrical shield with matched electrical impedance between said male element and said female element thereby to provide an electrical circuit connection preventing acoustic noise or electrical circuit damage when subjected to abrupt disconnection.

4. The connector assembly of claim 2 wherein said signal member is connected to the central conductor of said coaxial cable by flexible signal conductive means for maintaining signal continuity independent of the compression state of said spring means.

5. The connector assembly of claim 4 wherein said first element includes a plurality of signal members and said second element includes complementary contact members.

6. A coaxial cable connector assembly for connecting a first cable to a second cable, each cable having a central conductor covered by an inner insulation layer with a conductive braid in turn covering said inner insulating layer, said assembly comprising:

a first conductive element including a signal member having a pin contact part and a pin attachment part conductively connected to a flexible conductor in turn connected to the central conductor of said first cable, a first dielectric member encircling said pin attachment part and said flexible conductor and extending over a portion of said pin contact part, a first magnet member encircling said first dielectric member, and a first conductive shielding means encircling said first magnet member and extending over said first magnet member to provide a generally planar mating face for said first element, said first shielding means electrically connected to the braid of said first cable;

a second conductive element including a first end for conductively connecting to the central conductor of said second cable and a second end for complementary contact with said pin contact part, a second dielectric member encircling said second end; a second magnet member encircling said second dielectric member, and a second conductive shielding means extending over said second magnet member to provide a generally planar face for mating with said mating face of said first element, said second shielding means electrically connected to said braid; and wherein said first and second magnet members are of opposite polarity providing that said first and second elements when mated at their respective mating faces remain continuously connected in the absence of excessive break away forces.

7. The connector assembly of claim 6 wherein said pin attachment part includes spring means compressing in response to pressure applied to said pin contact part to allow depression of said pin contact part into said first element, and expanding at released pressure to establish contact with said second end of said second element.

8. The connector assembly of claim 6 wherein the mating of said first and second elements provide a continuous electrical shield with matched electrical impedance between said first and said second cables.

9. The connector assembly of claim 6 wherein the mating of said first and second elements in an acoustic system provides an electrical circuit connection preventing acoustic noise or electrical circuit damage when subjected to abrupt disconnection.

10. The connector assembly of claim 7 wherein said first element includes a plurality of pin members and said second element includes complementary contact members.

11. A connector assembly for a coaxial cable comprising:

first and second mating elements, said first element having a signal conductive member for mating with a complementary member in said second element;

said first and second elements having mating surfaces with respective magnetic means for maintaining connection of said first and second elements and disconnecting said first and second elements upon subjection of disruptive forces to said connector assembly; and said first and second elements including respective conductive shielding means connected to respective grounded braids and extending over respective magnetic means.

12. The connector assembly of claim 11 wherein said magnetic means includes a permanent magnet in said first element and a permanent magnet of opposite polarity in said second element.

13. The connector assembly of claim 11 wherein the mating of said first and second elements provides a continuous electrical shield.

14. The connector assembly of claim 11 whereby the mating of said first and second elements provide matched electrical impedance between said first and second elements to thereby provide an electrical circuit connection preventing acoustic noise or electrical circuit damage when said first and second elements are subjected to abrupt disconnection.

15. The connector assembly of claim 11 including spring means for urging electrical connection of said first and second elements and wherein said connector includes flexible signal conductive means for maintaining signal continuity independent of the compression state of said spring means.

16. The connector assembly of claim 11 wherein said signal member includes a pin contact part and a pin attachment part conductively connected to a flexible conductor in turn connected to the central conductor of a first coaxial cable, a first dielectric member encircling said pin attachment part and said flexible conductor and extending over a portion of said pin contact part, a first magnet member encircling said first dielectric member, and a first conductive shielding means encircling said first magnet member and extending over said first magnet member to provide a generally planar mating face for said first element, said first shielding means electrically connected to the braid of said first cable; and said second element includes a first end for conductively connecting to the central conductor of a second coaxial cable and a second end connected to said complementary member for conductively connecting to said pin contact part, a second dielectric member encircling said second end; a second magnet member encircling said second dielectric member, and a second conductive shielding means extending over said second magnet member to provide a generally planar face for mating with said mating face of said first element, said second shielding means electrically connected to the braid of said second cable.

17. The connector assembly of claim 16 wherein said first element includes a plurality of pin members and said second element includes complementary contact members.

18. The connector assembly of claim 16 wherein the mating of said first and second elements in an acoustic system provides an electrical circuit connection preventing acoustic noise or electrical circuit damage when subjected to abrupt disconnection.

* * * * *